US005639419A

United States Patent [19]

Morando

[11] Patent Number: 5,639,419

[45] Date of Patent: Jun. 17, 1997

[54] BUBBLE OPERATED DROSS DILUTING PUMP FOR A STEEL TREATING BATH

[76] Inventor: Jorge A. Morando, 220 W. Jefferson Ave., Trenton, Mich. 48183

[21] Appl. No.: 529,683

[22] Filed: Sep. 18, 1995

Related U.S. Application Data

[63] Continuation-in-part of Ser. No. 489,322, Jun. 12, 1995.

[51] Int. Cl.[6] ..... B05C 3/00

[52] U.S. Cl. ..... 266/112; 266/133; 266/227; 266/239; 118/422

[58] Field of Search ..... 266/112, 130, 266/133, 227, 230, 239; 118/422

[56] References Cited

U.S. PATENT DOCUMENTS

| | | | |
|---|---|---|---|
| 2,074,498 | 3/1937 | Wean | 266/227 |
| 2,166,250 | 7/1939 | Herman | 118/422 |
| 3,914,481 | 10/1975 | Boestroem | 118/422 |
| 5,084,094 | 1/1992 | Francios et al. | 266/227 |

*Primary Examiner*—Scott Kastler
*Attorney, Agent, or Firm*—Charles W. Chandler

[57] ABSTRACT

A fabricated bubble operated pump for diluting dross in a steel treating bath.

8 Claims, 2 Drawing Sheets

BUBBLE OPERATED DROSS DILUTING PUMP FOR A STEEL TREATING BATH

CROSS-REFERENCE TO RELATED APPLICATION

This application is a continuation-in-part of application Ser. No. 08/489,322, filed Mar. 12, 1995 for "Bubble Apparatus for Removing and Diluting Dross in a Steel Treating Bath".

BACKGROUND OF THE INVENTION

In my co-pending patent application, I disclosed a bubble apparatus for diluting dross in a steel treating bath. The bubble apparatus includes a pump with no moving parts for delivering molten metal from a remote area to the metal line where the dross floats on the bath. The pump delivers relatively pure metal to dilute the dross within the snout which houses the steel strip entering the bath, such as during a plating or galvanizing process.

The pump comprises a U-shaped tubular conduit that can be manufactured from stainless steel, or other alloy materials depending upon the molten metal in the bath. Certain ceramic materials available from Alphatech, Inc. of Trenton, Mich. also have proven to be very effective as a pump material. The pump body is cast into a one piece U-shaped configuration, however, such a casting is difficult to make.

SUMMARY OF THE INVENTION

The broad purpose of the present invention is to provide an improved bubble-operated dross diluting pump fabricated of a few easily manufactured components. The preferred embodiment of the invention comprises three linear elements. The first element is a vertical leg which may be made of either ceramic or graphite. It has a vertical passage for receiving the inert gas which forms the bubbles, preferably nitrogen. A bracket supports the vertical leg from the snout.

The second element is a horizontal leg which has an internal passage connected to the lower end of the vertical passage. One end of the horizontal leg has a sleeve that encircles the lower end of the vertical leg. The horizontal leg is also made of either graphite or ceramic.

The third element is a pumping tube formed of a ceramic material for passing molten metal from a lower position in the pot to the dross level. The interior passage in the pumping tube is fluidly connected to the gas passage in the horizontal leg in such a manner as to produce a series of rising bubbles in the tube which induce the upward flow of metal in the tube.

The pump is made of three main non-moving components which can be readily fabricated and mounted in position.

Still further objects and advantages of the invention will become readily apparent to those skilled in the art to which the invention pertains, upon reference to the following detailed description.

BRIEF DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
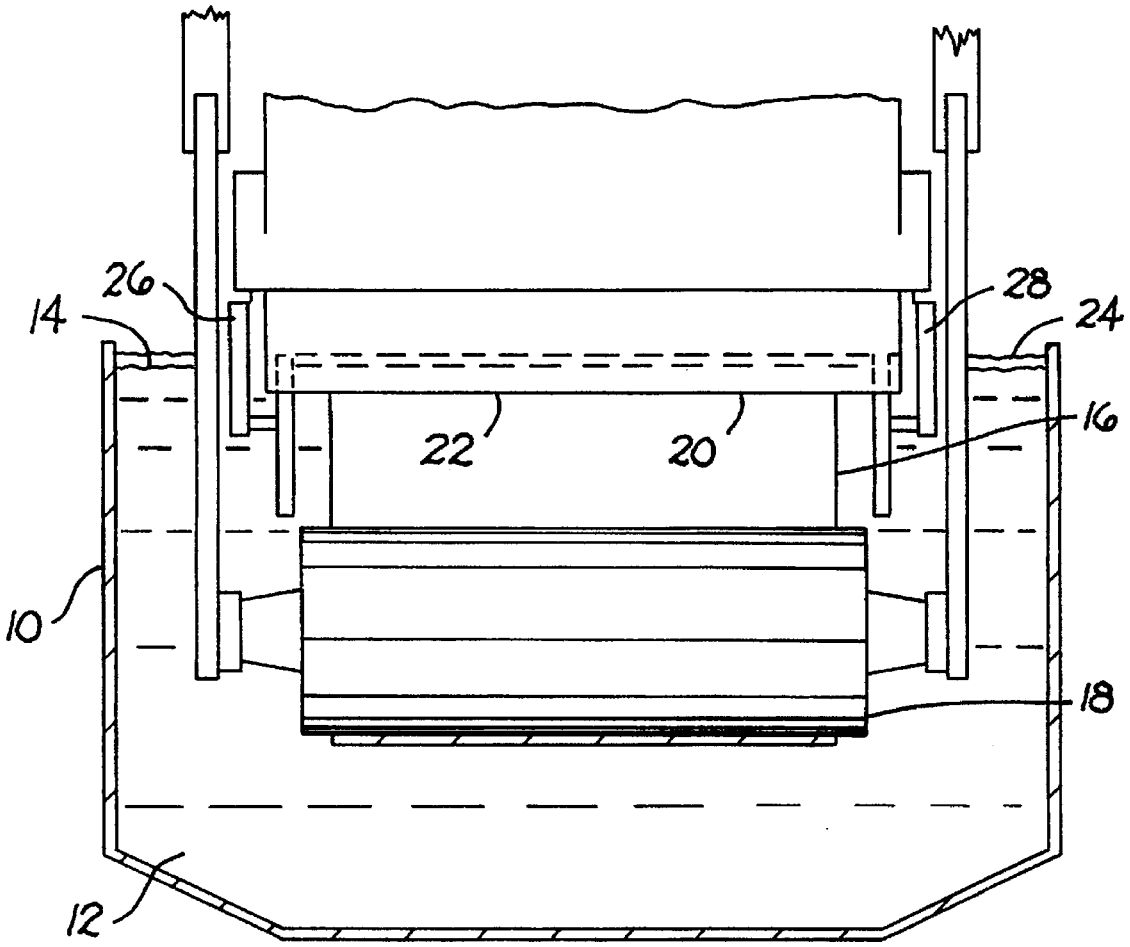
FIG. 1 is a sectional view of a pot containing molten metal to show the location of the dross diluting pump. For illustrative purposes, two pumps are shown.

Referring to the drawings, FIG. 1 illustrates a conventional heated metal pot 10 which for illustrative purposes, contains a bath 12 of molten aluminum. The bath has a top surface 14 usually referred to as the molten metal line. A continuous moving strip of low carbon steel 16 is introduced into the bath from a furnace (not shown) in the conventional manner. The strip passes around a sink roll 18 while submerged in the bath so that the surface of the strip picks up an aluminum coating.

Strip 16 is delivered to the bath through a conventional tubular snout 20. The interior of the snout, on the right side of one wall of the snout as viewed in FIG. 2, contains an inert gas such as nitrogen, or a mix of nitrogen and hydrogen, which as is well known to those skilled in the art, is useful in preventing the steel strip from oxidizing. Oxidation damages the aluminum coating being applied to the strip.

The lower exit opening 22 of the snout is disposed six to twelve inches below top surface 14 of the bath to assure a sealed area for the inert gas in the snout. The steel strip enters the bath and passes through lower opening 22, submerged in the molten metal by a series of rotating rolls including roll 18. The strip emerges from the bath and passes onto air knives (not shown) which remove any excess coating metal as the strip passes onto its next destination.

The chemical reaction occurring between the steel strip oxides and the aluminum in the bath creates a dross layer 24 that accumulates at surface 14 inside the snout.

The two bubble pump means 26 and 28 deliver molten aluminum from a lower location in the pot to the dross layer inside the snout to dilute the dross.

Figure 2:
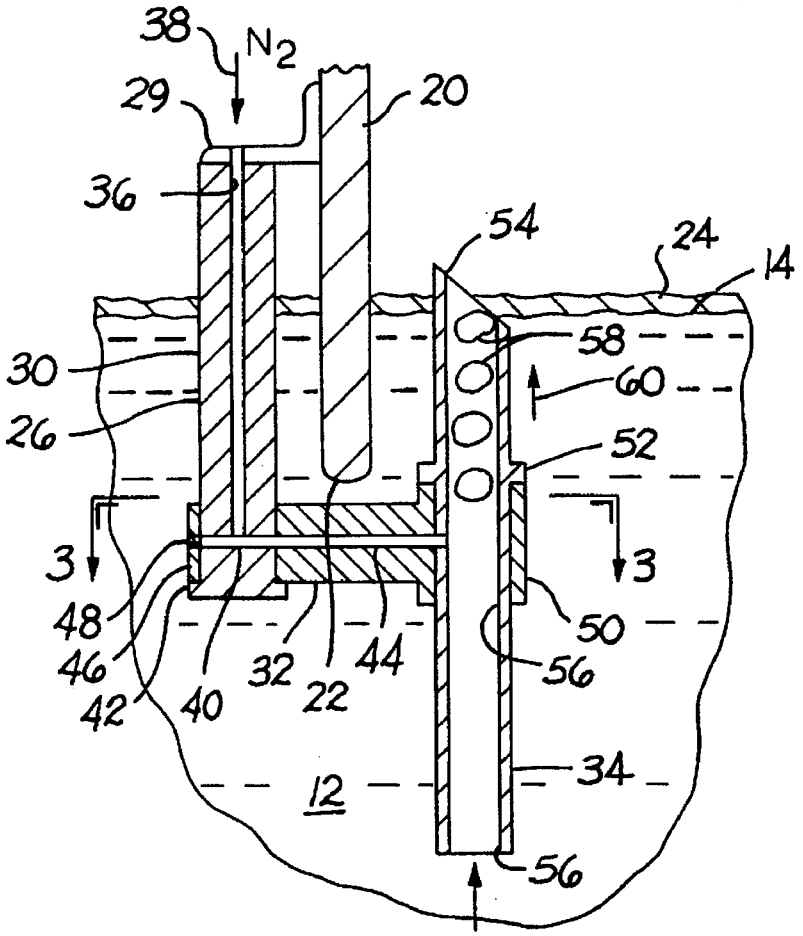
FIG. 2 is an enlarged sectional view of a typical improved dross diluting pump.
Figure 3:
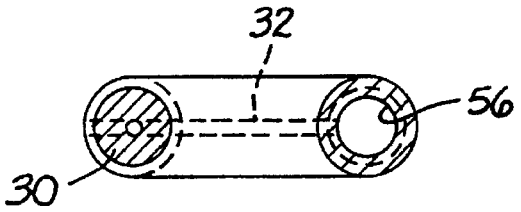
FIG. 3 is a plan sectional view, generally as seen along lines 3—3 of FIG. 2.

Referring to FIGS. 2 and 3, typical dross diluting pump means 26 is supported by a bracket means 29 to the snout. The pump comprises three linear components including a vertical leg 30, a horizontal leg 32 and a vertical molten metal pumping tube 34. Leg 30 is preferably formed of a ceramic but can be formed of graphite depending upon the metal in which it is submerged. Leg 30 has a vertical centrally located gas delivery passage 36 for passing an inert gas, such as nitrogen, from a source 38. The upper end of leg 30 is above the dross level. The lower end is disposed (about six to twelve inches) below the metal line of the bath sufficiently to clear snout 20. Passage 36 is fluidly connected to a short horizontal passage 40.

The extreme lower end of leg 30 has an integral collar 42.

Horizontal leg 32 is preferably formed of ceramic but may also be formed of graphite depending upon the material in which it is submerged. Horizontal leg 32 also has a centrally located gas delivery passage 44 which is fluidly connected with short passage 40. Horizontal leg 32 has one end formed with a sleeve 46 which is mounted around the lower end of vertical leg 30 and seated on collar 42. Passage 44 is formed by drilling through sleeve 46 and through horizontal leg 32. Plug 48 blocks the inlet of the drilled hole in sleeve 46.

The opposite end of horizontal leg 32 has a sleeve 50 which telescopically receives pumping tube 34.

Pumping tube 34 has an integral collar 52 seated on sleeve 50. The location of tube 34 is such that its upper outlet end 54 is disposed in dross layer 24. Preferably outlet end 54 has a beveled configuration formed at about a 45° angle to metal line 14.

The lower end of tube 34 has an inlet opening 56. The length of the lower end of the delivery tube is located to receive relatively uncontaminated molten metal from the lower part of the pot. Preferably the pumping tube is formed of a ceramic which is resistant to the molten metal. In a zinc galvanizing bath, tube 34 can be manufactured from a stainless steel material or AT-103, or AT-103A, a metallic alloy material available from Alphatech, Inc. of Trenton, Mich., specially formulated for resistance to zinc at temperatures up to 1400° fahrenheit.

The joints between the opposite ends of horizontal leg 32, the vertical leg and the pumping tube are covered with a slurry of the ceramic material and then the ceramic pump is baked in the usual manner in a furnace.

In Galvalume, (aluminum and zinc) or aluminum, tube 34 can be manufactured from any ceramic material resistant to these molten metals or RBSN-AL25, a ceramic material also available from Alphatech, Inc. which has proved to be extremely resistant to molten aluminum attack at temperatures up to 1600° fahrenheit. For most galvanizing or aluminum lines, a pumping tube diameter of two and a half to three inches is sufficient.

In operation, the nitrogen is delivered in either a continuous or an intermittent form. In either case, the gas passes through passage 44 into the interior delivery passage 56 of the pumping tube and forms a series of bubbles 58 because of surface tension. The bubbles rise in the tube. The rising bubbles entrap sections of molten aluminum between them and carry the sections upwardly in the direction of arrow 60.

When applying an intermittent flow of gas, the utilization of the gas can be optimized by adjusting the frequency of the bubble formation and the expansion rate to match the particular application. The rising bubbles induce the flow of molten metal towards outlet opening 54, generating a suction or vacuum condition at inlet opening 56. A substantial and continuous flow of relatively pure aluminum is delivered inside the snout, diluting the dross and thereby minimizing not only the amount but the particulate size of the dross adjacent the moving strip of steel. This is particularly desirable in order to prevent the dross from attaching itself to the moving steel strip which deteriorates its quality.

Having described my invention, I claim:

1. In a metal treating apparatus having a pot holding a bath of molten metal, a gas-filled snout enclosing a moving strip of metal entering the bath, the snout having an opening below the surface of said bath to which the strip of metal exits while submerged in the molten metal, apparatus for diluting a layer of dross on the surface of the metal bath inside the gas-filled snout including a pumping tube having a lower inlet opening disposed in the bath for passing relatively pure metal from a position spaced beneath the surface of the bath of metal; the pumping tube having an outlet opening for discharging molten metal received through the inlet opening to a location adjacent the layer of dross inside the gas-filled snout; the pumping tube having a gas receiving opening below the outlet opening; and means for introducing a gas which tends to rise in said molten metal into said gas-receiving opening to induce a flow of molten metal through said pumping tube; the improvement comprising:

an L-shaped support having a vertical leg member and a horizontal leg member;

the vertical leg member having a first gas-conducting passage;

the horizontal leg member having a second gas-conducting passage fluidly connected to the first gas conducting passage, the second gas conducting passage having an outlet;

an upright tube attached to the outlet of the second gas conducting passage, the upright tube having a metal pumping passage for passing molten metal therethrough from a lower inlet end toward an upper outlet end;

said metal pumping passage being fluidly connected to the gas conducting passage; and means supporting the upright tube such that the upper end of the upright tube is disposed adjacent the dross level in the snout.

2. An improvement as defined in claim 1, in which the vertical leg member comprises a substantially linear vertical first support member, and the horizontal leg member comprises a second substantially linear member.

3. An improvement as defined in claim 1, in which the first vertical leg member is formed of a ceramic material, the horizontal leg is formed of a ceramic material, and the upright tube is a formed of a ceramic material.

4. An improvement as defined in claim 1, in which the vertical and the horizontal leg members are each formed of a graphite material.

5. An improvement as defined in claim 1, in which the horizontal leg has one end with a sleeve embracing the lower end of the vertical leg and an opposite end with a sleeve embracing the upright tube.

6. An improvement as defined in claim 5, in which the vertical leg has a lower end with a collar for seating one end of the horizontal leg, and the upright tube has an annular collar seated on the upper end of the sleeve carried by the horizontal leg.

7. An improvement as defined in claim 1, in which the vertical leg member is parallel to the upright tube.

8. An improvement as defined in claim 1, in which the vertical leg member, the horizontal leg member and the upright tube are fabricated into a unitary unit having no moving parts.

* * * * *